US006227539B1

(12) United States Patent
Ferrara

(10) Patent No.: US 6,227,539 B1
(45) Date of Patent: May 8, 2001

(54) PRINTER MAILBOXING SYSTEM WITH AUTOMATIC VARIABLE CAPACITY BINS

(75) Inventor: Joseph J. Ferrara, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/176,447

(22) Filed: Oct. 21, 1998

(51) Int. Cl.[7] ..... B65H 39/10

(52) U.S. Cl. ..... 271/293; 271/294; 271/298; 271/288

(58) Field of Search ..... 271/287, 288, 271/292, 293, 294, 298, 299

(56) References Cited

U.S. PATENT DOCUMENTS

| | | | | |
|---|---|---|---|---|
| 3,788,640 | | 1/1974 | Stemmle | 271/64 |
| 3,907,279 | | 9/1975 | Ervin | 271/173 |
| 4,214,746 | * | 7/1980 | Redding et al. | 271/294 |
| 5,284,339 | * | 2/1994 | Van Opstal et al. | 271/288 |
| 5,342,034 | * | 8/1994 | Mandel et al. | 270/53 |
| 5,382,012 | | 1/1995 | Mandel et al. | 270/53 |
| 5,547,178 | | 8/1996 | Costello | 270/52.02 |
| 5,599,009 | | 2/1997 | Mandel et al. | 270/58.09 |
| 5,761,600 | | 6/1998 | Murata | 399/403 |
| 5,810,352 | | 9/1998 | Kobayashi et al. | 271/293 |

FOREIGN PATENT DOCUMENTS

0888994 * 1/1999 (EP) .

* cited by examiner

*Primary Examiner*—Christopher P. Ellis
*Assistant Examiner*—Patrick Mackey

(57) ABSTRACT

In a mailboxing system in which the different numbers and types of printed sheets being printed by the different users of a shared users printer are separately stored in different assigned mailbox bins in an array of mailbox bins, there is provided a system for automatically changing the spacing between selected adjacent bins to provide selectably different sheet stacking capacities for different bins for the different numbers of printed sheets being stored in the respective bins of different users. With this system the bin capacity can also be automatically reduced when the sheets are removed from that bin. Greatly increased overall and individual bin sheet stacking capacity is thus provided for the same overall system size as compared to conventional fixed spacing bins. Also, many more print jobs can be stored in the same user-assigned bin instead of having to split up large print jobs into other, overflow, bins. A simple split (dual independently rotated sections) auger bin movement system can provide the automatic bin repositioning for the selectable variable bin capacity.

13 Claims, 3 Drawing Sheets

PRINTER MAILBOXING SYSTEM WITH AUTOMATIC VARIABLE CAPACITY BINS

Disclosed in the embodiments herein is an improved system by which individual bins of a multibin printed sheets separating system can automatically increase or decrease their sheet stacking capacity relative to other bins for variable numbers or sizes of print jobs being directed to individual bins. This can provide an improved multibin mailboxing system for the print jobs of shared user printers, providing automatically variable capacity bins for the varying utilizations, varying outputs, and varying time delays between bin unloadings, of the various users of the associated printer.

The system disclosed in the embodiments herein can provide a desirable variable bin capacity in a multibin sheet output separation and storage system with a relatively simple and low cost mechanism having a relatively simple control and drive system.

A significant advantage of the disclosed mailboxing system is that a higher print output temporary storage capacity can be provided for individual users, on average, to provide an effectively "larger mailboxes" mailboxing system, without requiring an increase in the overall size of the mailboxing system.

Providing variable capacity bins in a mailboxing system, particularly one with an upstream sets finisher, as shown in above-cited patents, allows greater flexibility with respect to mailbox job size limitations in a number of other respects. For example, the disclosed system does not require a large print job to be sent to an open general user tray such as an elevator tray, where a lack of privacy would exist due to the openness thereof, as well as confusion with other such overflow large print jobs from other users. Nor do large or multiple print jobs need to be redirected to secondary locations, since any tray can be automatically adjusted for the increased capacity of the large print jobs, thus allowing all of the accumulated print jobs to be kept in a single, increasing capacity, bin until removed if desired. All the bins which are unused or from which print jobs have been removed can be minimized in capacity and spacing to greatly increase the maximum available capacity of other bins without subtracting from the number of bins or increasing the overall mailboxing system unit size. The productivity and useful up time for the associated printer can thus be improved.

A specific feature of the specific embodiments disclosed herein is to provide in a printed sheets distribution system for a printer comprising an array of multiple adjacent stacking bins into which printed sheets from the printer are selectively directed to be stacked in selected individual said bins, wherein different numbers of said printed sheets are selectively directed to different individual said bins, the improvement comprising an automatic bin capacity adjustment system which automatically increases or decreases the sheet stacking capacity of said selected individual said bins relative to other said bins in response to said different numbers of said printed sheets being directed to said selected individual said bins, said automatic bin capacity adjustment system automatically changing the spacing between selected said adjacent stacking bins to provide said automatically increases or decreases in the sheet stacking capacity of said selected individual said bins relative to said other bins.

Further specific features disclosed herein, individually or in combination, include those wherein a multiple mailbox bins mailboxing system for stacking therein print jobs of said printed sheets from said printer, wherein different individual said mailbox bins are assigned to different individual users of said printer, and wherein said printer is a shared users printers with plural said individual users respectively having variable numbers and sizes of print jobs, and wherein said print jobs of said individual users are separately directed to separate said individual said mailbox bins separately assigned to said individual users, and wherein said automatic bin capacity adjustment system automatically changes said sheet stacking capacity of said individual said mailbox bins for said individual users respectively having variable numbers and sizes of print jobs; and/or wherein said print jobs of said printed sheets from said printer are manually removable from said mailbox bins by said individual users, and wherein said automatic bin capacity adjustment system automatically reduces said sheet stacking capacity of said individual said mailbox bins from which said print jobs of said printed sheets have been so removed; and/or wherein said automatic bin capacity adjustment system comprises plural coaxial but independently rotatable screw threaded bin movement members, and a controlled drive system rotating at least one of said screw threaded bin movement members relative to another to change the spacing between adjacent said bins; and/or wherein said controlled drive system alternatively commonly rotates said plural coaxial but independently rotatable screw threaded bin movement members to commonly move said bins without changing the spacing between said bins, and/or in a mailboxing system for a shared users printer with different individual users, comprising an array of multiple adjacent mailbox bins, which mailboxing system separates and temporarily stores different numbers of printed sheets for said different users of said shared users printer in different said mailbox bins; the improvement comprising an automatic mailbox bin capacity adjustment system automatically varying the spacing between said mailbox bins to provide different sheet capacities for different said mailbox bins for said different numbers of printed sheets of said different users of said shared users printer; and/or wherein said printed sheets are manually removable from individual said mailbox bins by said individual users, and wherein said automatic bin capacity adjustment system automatically reduces said sheet stacking capacity of said individual said mailbox bins from which said printed sheets have been so removed to increase the available sheet stacking capacity of other said mailbox bins of said mailboxing system; and/or wherein said automatic bin capacity adjustment system comprises plural coaxial but independently rotatable screw threaded bin movement members, and a controlled drive system rotating at least one of said screw threaded bin movement members relative to another to change the spacing between adjacent said mailbox bins to change the sheet stacking capacity of selected said mailbox bins; and/or wherein said controlled drive system alternatively commonly rotates said plural coaxial but independently rotatable screw threaded bin movement members to commonly move said bins without hanging the spacing between said bins relative to a sheet entrance position for said mailbox bins; and/or wherein said automatic bin capacity adjustment system comprises a plurality of screw threaded bin movement members to which said mailbox bins are independently operatively attached in a vertical array, each said screw threaded bin movement member having upper and lower sections which are coaxial and have mating threads but are independently rotatable, and two separate and separately controlled drive motors connected to separately rotate said upper and lower sections of said screw threaded members relative to another to change the spacing between adjacent said mailbox bins to change the sheet stacking capacity of selected said mailbox bins; and/or in a mailboxing system for a shared users printer, having an array of multiple adjacent mailbox bins, which mailboxing system separates and stores different numbers of printed sheets for different users of said shared users printer into different said mailbox bins; the improvement comprising means for automatically varying the spacing between said mailbox bins to provide different sheet storing capacities for different said mailbox bins for said different users of said shared users printer; and/or in a printed sheets distribution system for a printer comprising multiple stacking bins into which multiple printed sheets from the printer are selectively directed to be stacked in said stacking bins, wherein said stacking bins are in a superposed array of said bins, there is provide a bins movement system which sequentially moves said bins relative to a sheet entrance position from which the printed sheets are fed into said bins, wherein said bins movement system additionally provides variable spacing and variable sheet stacking capacity for said bins which is variably selectable for different said bins; and/or a method of separating and storing different numbers of printed sheets for different users of a shared users printer in different mailbox bins of an array of plural mailbox bins, comprising automatically changing the spacing between selected adjacent mailbox bins to provide selectably different sheet storing capacities for different mailbox bins for the different numbers of printed sheets of the different users of the shared users printer.

By way of background, mailboxing systems differ from conventional sorting or collating systems in several important respects, even though they may often share some structural features. Of particular interest here, in contrast to mailboxing systems, sorters or collators normally put one sheet into each bin being used, one at a time, and end up each print job with only one identical, same size, collated copying or print job in each bin. Thus, all the sorter bins can all have the same sheet stacking capacity, which means the bins can all have the same vertical or horizontal spacing from one another, since that is what normally determines their sheet capacity. The exceptions can include one top "overflow" bin (not restricted in capacity by an overlying bin), and/or temporarily increasing the bin spacing between bins at the sheet entry position to assist sheet entry into the bin at the bin loading position. For example, Xerox Corp. U.S. Pat. No. 3,788,640 issued Jan. 29, 1974 to Denis J. Stemmle, or Canon U.S. Pat. No. 5,761,600 issued June 2, 1998 to M. Murata. Said U.S. Pat. No. 3,788,640 also shows a constant additional spacing provided between groups of bins for assisting in set removals. This patent also shows and describes a variable screw pitch auger drive for movement of the bins.

Of particular interest is newly issued U.S. Pat. No. 5,810,352 issued Sep. 22, 1998 to M. Kobayashi, et al., a divisional of U.S. Pat. No. 5,685,540, and claiming priority from an application filed June 3,1994 in Japan. This patent discloses a sorter with a rotational spiral cam screw rod sorting trays movement system in which the distance between the sorting trays in the vertical direction is different for stopping at two different rotational positions to provide a difference in between adjacent sorting trays in a sheet receiving mode and a sheet takeout mode where the sheets are taken out.

However, in contrast, mailboxing systems do not normally put the same number of sheets and stack sizes in each (mailbox) bin being used. A mailboxing system is for separating the different print jobs of different users, not for collating a single print job of a single user. Also, the output of electronic printers is normally pre-collated sets of plural sheets. Normally the different users of a printer-mailbox system will have very different numbers and sizes of print jobs, and since the different users normally have different assigned bins (mailboxes), the sheet stacking capacity needed for those bins can vary greatly between different bins. A fixed spacing between bins limits the maximum sheets stacking capacity of all the bins to that fixed inter-bin spacing. Thus, prior art mailboxing systems with fixed bin spacings had a fixed maximum bin capacity mailbox system. This has necessitated large and/or multiple print jobs for a given user to be interrupted and/or split up with parts of the users print job(s) being re-assigned as to an overflow bin or the overflow stacked in additional bins.

That presents further difficulties, as described in more detail for example in Xerox Corp. U.S. Pat. No. 5,547,178 issued Aug. 20, 1996 to Mark Costello. In particular, it requires a user to find and retrieve his print jobs from more than one bin, with additional "banner sheets" for the split jobs, and graphic user interface displays or instructions as to where the users bin overflow has been placed. Yet, in spite of these difficulties, mailboxing systems are preferable to the alternative of piling all of the different print jobs of all of the remote or local users (all of the printer output) in a single unsegreated pile in a single common stacking tray. Even with sets offsetting and banner sheets such common output stacking can lead to one user walking off with or scrambling the print jobs of another user in trying to remove his or her own print jobs from within the common pile. Furthermore the general trend in sheet handling, especially in reproduction apparatus, such as xerographic and other copiers and printers or multifunction machines, it is to recognize the increasing importance of providing faster yet more reliable and more automatic handling of the physical image bearing sheets.

By way of further background on mailboxing systems, there is also noted for example Xerox Corp. U.S. Pat. No. 5,599,009 issued Feb. 4, 1997, and U.S. Pat. No. 5,342,034 issued Aug. 30, 1994, to Barry P. Mandel, et al. The former U.S. Pat. No. 5,599,009 specifically relates to and discusses mailbox bins stack height limitations and controls, including the increase in the effective bin stack height and effectively reduced bin capacity when stapled sets are fed into a bin. Of particular interest in Col. 12 of the latter U.S. Pat. No. 5,342,034 is the following quotation re mechanically increasing bin spacings by removing bins: "When a sorter unit is to be alternatively used for, or converted to use for, a printer mailbox unit, it may be desirable to increase the available sheet stacking space between bin trays or shelves to increase bin capacity. Moving or removing sorter bin shelves for doubling or tripling the number of multiple copies which a particular bin can receive is taught for a sorter per se in U.S. Pat. No. 3,907,279 issued Sep. 23, 1975 to J. H. Erwin by AM Corp. See especially Col. 3. Doing so for different numbers of copies or documents to different users in preprogrammed bin sequences is suggested in Col. 1." An "elevator" stacking tray may be integrated into an array of constant spacing bins of a mailboxing system, as in Xerox Corp. U.S. Pat. No. 5,382,012 issued Jan. 17, 1995 to Barry P. Mandel, et al. However, that does not address the above-discussed problems being addressed here. It merely allows for u unseparated overflow stacking in what is in effect only a single bin, and the space between the other, fixed, bins is fixed to the maximum capacity of this elevator stacking tray.

As taught by the above-cited and many other references, the disclosed system may be operated and controlled as described by appropriate operation of conventional control systems. It is well-known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or VLSI designs. It is well known in the art that the control of sheet handling systems may be accomplished by conventionally actuating them with signals from such a programmed microprocessor controller, network software, and/or job description language software, directly or indirectly in response to programmed commands and/or from selected actuation or non-actuation of conventional switch inputs or sensors. The resultant control signals may conventionally actuate various conventional electrical solenoids, servo or stepper motors, clutches, or other components, in the programmed steps, sequences and amounts.

In the description herein the term "sheet" refers to the usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is already well known to those skilled in the art need not be re-described here.

Various of the above-mentioned and further features and advantages will be apparent from the specific apparatus and its operation described in the example below, although the claims are not limited to these examples. Thus, the present invention will be better understood from this description of a specific exemplary embodiment, including the drawing figures, (approximately to scale) wherein:

Figure 1:
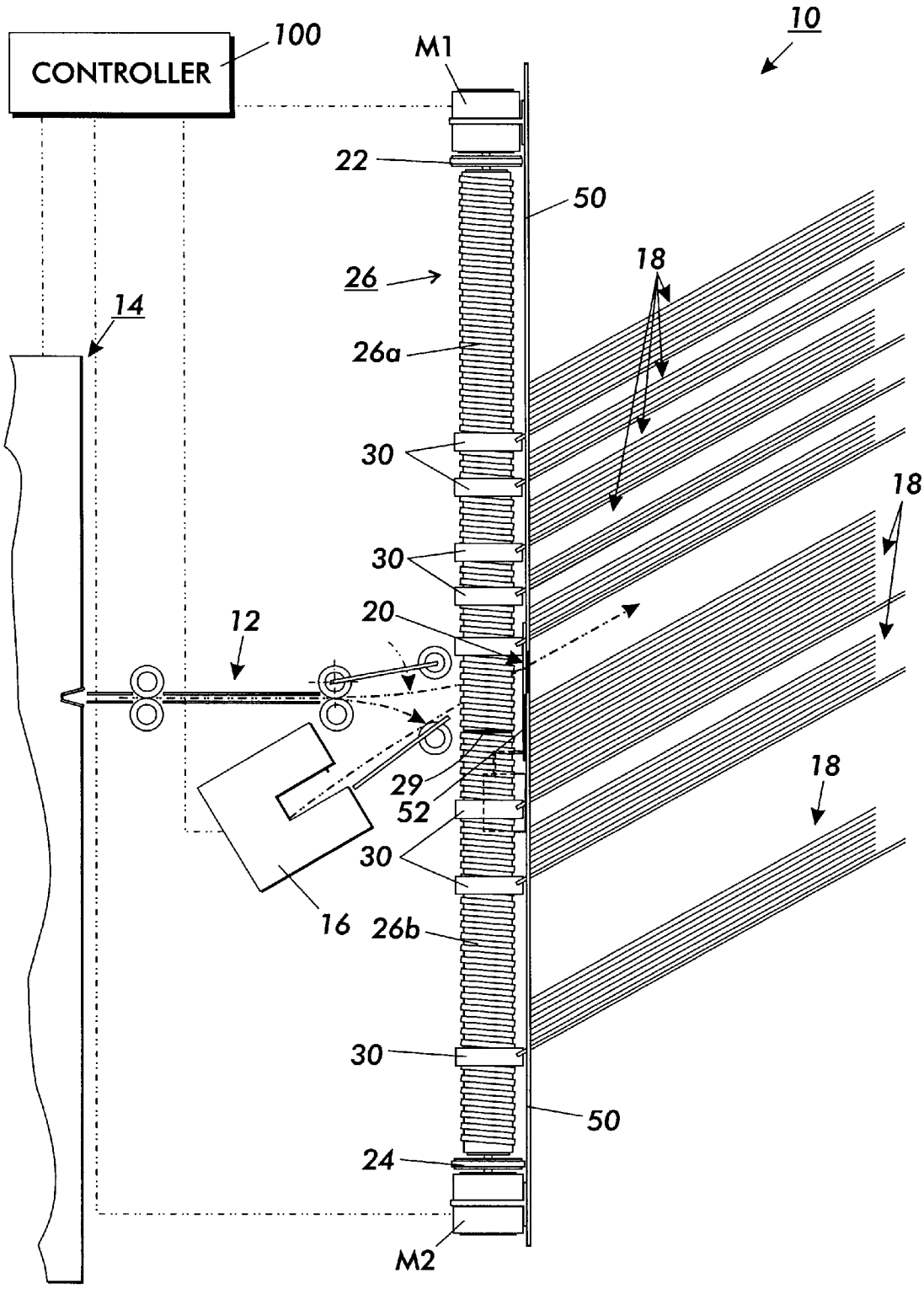
FIG. 1 is a partially schematic front plan view of one embodiment of the subject variable bin capacity mailboxing system, with dashed lines showing a sheets input path.
Figure 2:
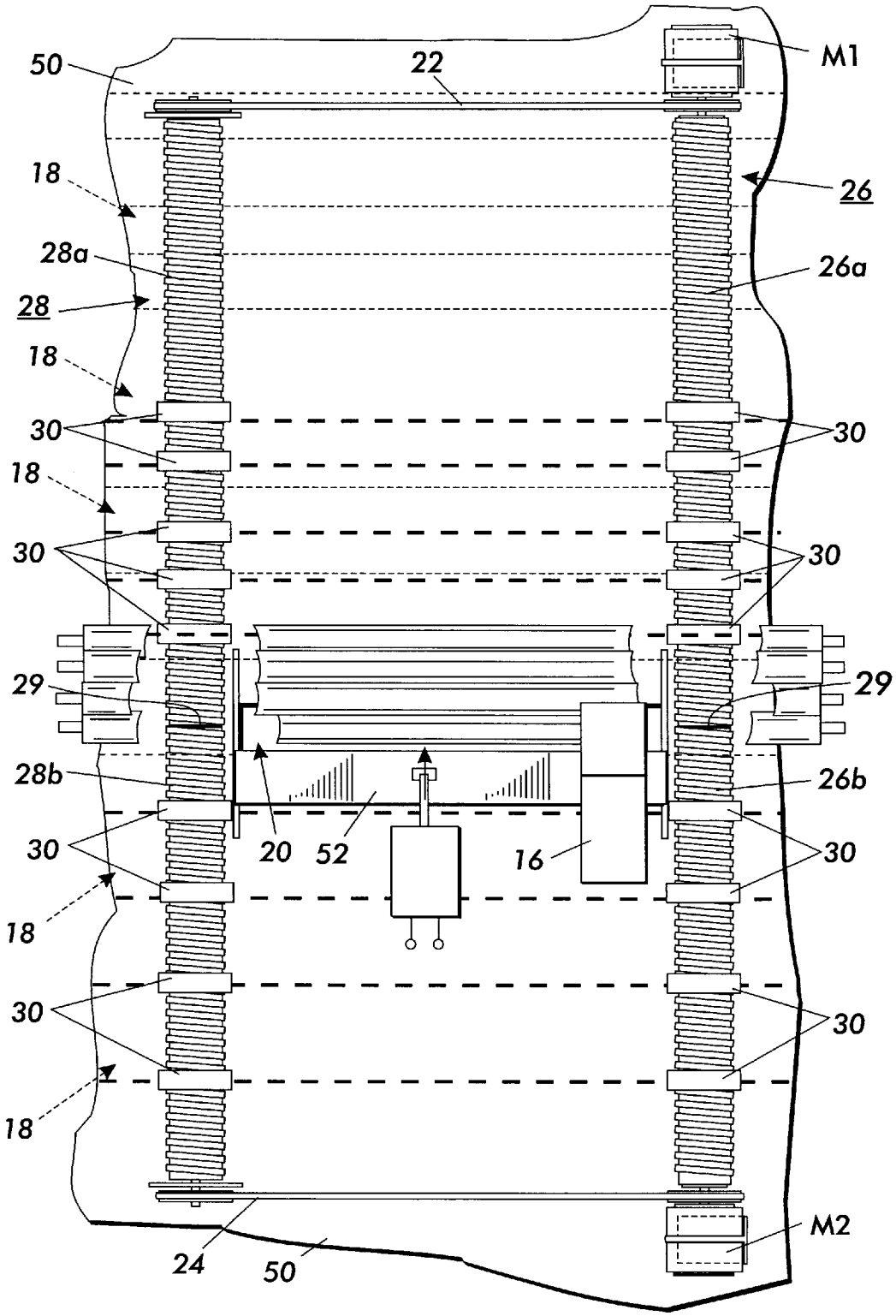
FIG. 2 is a side view of the embodiment of FIG. 1.
Figure 3:
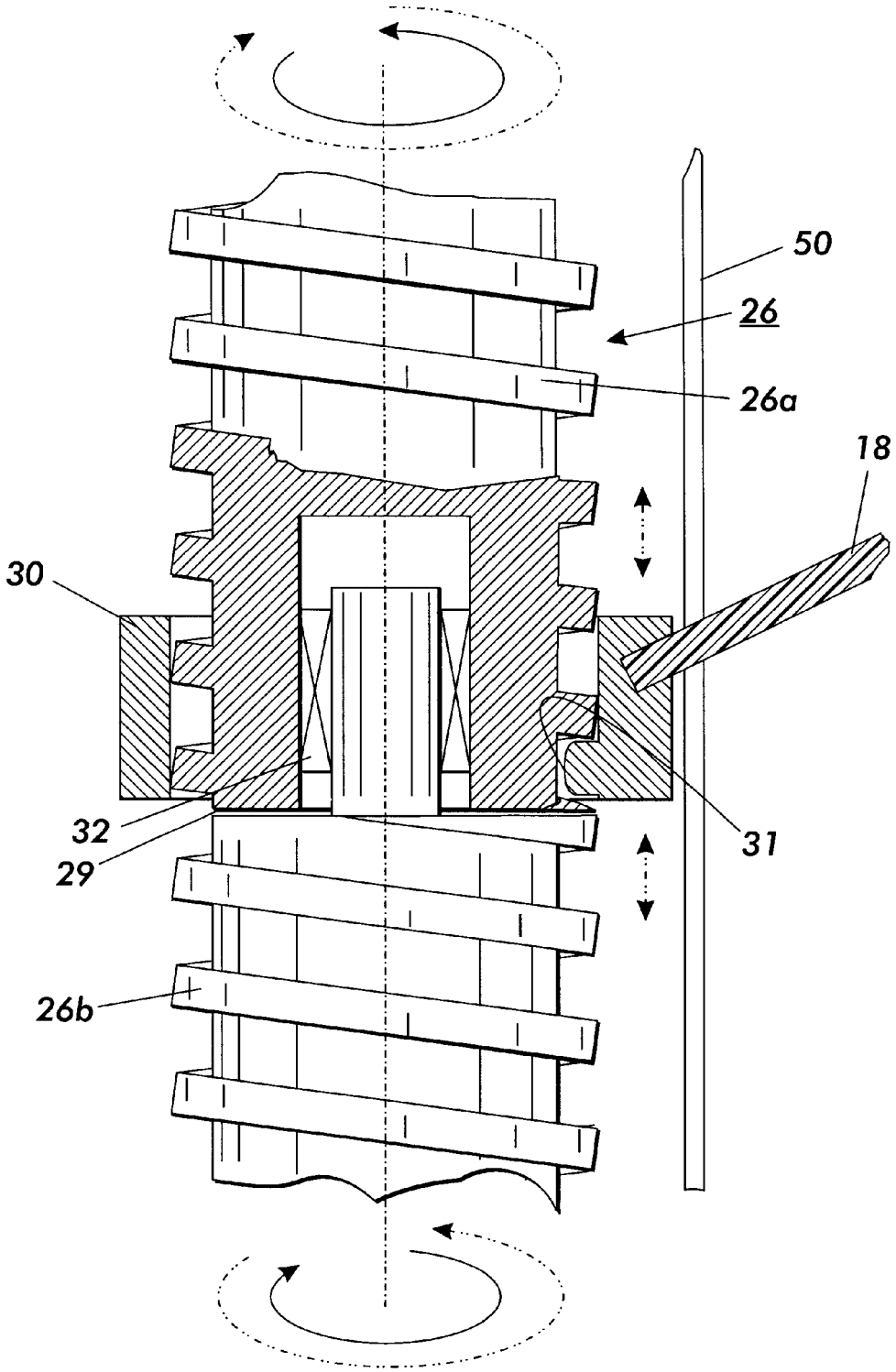
FIG. 3 is an enlarged and partially cross-sectional view of the central portion of FIG. 1 further illustrating an exemplary bin space changing system comprising here a split or two part bin lead screw which can be separately driven, as further explained below.

Describing now in further detail the exemplary embodiment with reference to the figures, there is shown in FIGS. 1–3 an automatic variable bin capacity mailboxing system 10 merely by way of one example or applications of the subject system. Referring particularly to FIG. 1, printed sheets for an assigned user are sequentially fed into the sheet entrance path 12 of the mailboxing system 10 from the operatively connecting printer 14 under the control and tracking of a controller 100 located there, in the printer, or in the network, as further described in the above cited and other printer and mailboxing system patents. The mailboxing system 10 may have its own electrically interconnected controller 100 or utilize the printer and/or network controller. Thus, the number of sheets and print jobs thereof for a particular user being outputted from the printer 14 to the system 10 is a known quantity.

As shown by the dashed line sheet paths, the incoming sheets may be directly fed into an assigned bin 18 of the mailbox unit or module 10 or first be compiled with other sheets and finished in a compiler-finisher, as by stapler 16 here, and each stapled finished set fed into the bin 18, as described in the above-cited mailbox system patents, although such an upstream compiler-finisher is an optional feature and not a requirement of a mailboxing system. In either case the sheets or sets thereof are fed into the selected bin 18 at a bin entrance 20. The controller 100 moves the bins 18 up and down past the bin entrance 20 here by means of stepper motors M1 and M2 rotatably driving, directly and by interconnecting timing belts 22 and 24, threaded augers or lead screws 26 and 28, respectively at the front and back of the bin array. These lead screws 26 and 28 are partially similar in function to those in the above-cited U.S. Pat. No. 3,788,640 or the corresponding old Xerox Corp. "4500" copier-sorter product.

The process of assigning mailbox bins to specific users of shared printers, loading sheets or stapled sets of sheets into assigned mailbox bins, tracking or sensing the stack height within the bins, etc., is all fully explained in above cited and other references. Accordingly they need not be described in detail herein.

Here, two ring-shaped bin followers 30 per bin independently cantilever support the inner or input end of a respective bin 18. The bin followers 30 engage the threads of the lead screws 26 and 28, for example as better shown in FIG. 3. Thus the bin followers 30 are supported and vertically moved in accordance with the rotation of these lead screws 26 and 28 to move their respectively attached bins.

However, particularly here that the lead screws 26 and 28 here are each split into two separate sections; **26*a* and 26*b*, and 28*a* and 28*b*. These separate lead screw sections are coaxial and have the same diameter and thread patterns, but are independently rotatable. As shown in FIG. 3, these lead screw sections have an internal interconnecting bearing 32 providing for this independent but coaxial rotation by their separately connecting stepper motors M1 and M2. That is, as shown in FIG. 1, the motor M1 connects to and rotates only the upper lead screw section 26*a*, while the motor M2 connects to and rotates only the lower lead screw section 26*b*. As shown in FIG. 2, these same rotations are imparted to the other, rear, lead screw sections 28*a* and 28*b* via belt drives 22 and 24**.

The respective coaxial lead screw sections closely mate with one another about their central bearing 32, so that there is a minimal gap or transition 29 in the external threading thereof. This allows each bin follower 30 and its bin 18 to be transitioned from one lead screw section to the other, i.e. to be vertically moved from **26*a* to 26*b*, and simultaneously vertically moved from 28*a* to 28*b*, or vice versa, depending on the direction of rotation of the lead screw section (and whether the threading of the lead screw 26** is right handed or left handed).

By this arrangement, the capacity of any selected mailbox bin 18 here may be increased or decreased, as will be explained. This may be accomplished simply by means of this dual lead screw and stepper motors configuration and different operation of their respective stepper motors, in contrast to the prior art having integral continuous lead screws rotated by a single drive motor. Here there are two coaxial lead screws independently operated by two different drives, one occupying the top half and one occupying the bottom half of the system 10. Since the lead screw sections can be independently rotated either clockwise or counterclockwise by their respective independent drive motors, the bin separation of any selected bin can be increased or decreased at the conjunction of the coaxial lead screw sections by different rotation of the two sections. That is, the bin followers 30 on the upper lead screw section will be moved or not depending on the rotation of that upper section, while the bin followers 30 on the lower lead screw section will be moved or not depending on the rotation of that lower section. Thus all of the bins above the intersection of the two lead screw sections can be moved relative to all of the bins below the intersection, or vice versa. This increases or decreases the bin spacing and capacity of the particular bin which has been advanced by rotation the screw threads to immediately below the intersection of the two screw thread sections.

This is also the point in which the sheets enter the bin, so this can be done on the fly in conjunction with the normal process of widening the space between the bins which are at the sheet entrance position to the bins at the bin entrance 20. After the completion of the loading of the print job or jobs to be loaded into that particular bin 18 at that time, both of the coaxial lead screw sections may be commonly rotated in unison, so that the entire set of bins moves up or down together, in the normal manner of a moving-bins mailbox system, until the next the bin to be loaded is moved to the bin entrance position 20, under the split 29 between the two lead screw sections. That is, the independent stepper motor drive M1 and M2 here may be driven synchronously in one direction for common driving of the top and bottom lead screws in one direction to provide loading access to the proper bin without changing the spacing between the bins. Yet here these independent drives M1 and M2 can also be driven in opposite directions, or only one of them driven, to either increase or reduce the capacity of any respective bin as described.

As shown in FIGS. 1 and 2, to assist in the variable capacity of the bins here, instead of a fixed vertical height integral backwall on the bins, the inside or registration side of these bins 18 (which slope downwardly toward that inside registration edge) may be confined and defined by a large fixed backwall member 50. This backwall or registration member 50 here is apertured in the bin entrance area 20 to allow the sheets to pass therethrough. It is also vertically apertured to allow tabs on the bins to connect into the bin followers 30 and for those tabs to move vertically though those apertures in the backwall 50 without interference. Alternatively, variable height stacking registration edge walls may be provided for the bins, as shown and described for example in Xerox Corporation U.S. Pat. No. 5,346,203, issued Sep. 13, 1994 to Denis J. Stemmle (D/89467).

The paper path opening or aperture in the backwall 50 at the bin entrance 20 may be shuttered when bins with sheets already in them are traversing this apertured zone. That can occur, for example when other jobs are being printed for other users, requiring loading access to another bin, so that the array of bins needs to be moved up and down to a selected bin or bins for that user. This shuttering is accomplished here with a sliding door 52. The door 52 may be opened or closed by a solenoid as schematially shown in FIG. 2, or other simple mechanism. It may be actuated to close the door 52 whenever both of the stepper drive motors M1 and M2 are actuated for driving in the same direction of rotation, since that is done here during the bin location (selection). The door 52 does not need to be closed when only the lower drive M2 is engaged, since in that case the system 10 is operating for increasing or reducing the bin capacity of the one bin being loaded, and other bins previously loaded with sheets of paper are not traversing the bin entrance 20 opening at that point in the operation.

The drives M1 and M2 may also be controlled using the known position of rotation thereof, which is commonly available information from stepper motors. This allows the respectively driven lead screw sections to be driven so as to stop in whole (360 degree) increments of rotation, so as to maintain a substantially continuous thread transition in the pitch of the lead screw at the interface between the lead screw's upper and lower sections when the bin followers 30 are being screwed up or down past the sections transition. However, as shown in FIG. 3 for example, a simple cam follower knob 31 may be utilized for the bin followers 30 instead of full threading inside the cam followers 30, so as to provide transition of the cam followers between the threads on the upper and lower sections of the lead screws even if the threading between the two sections is not continuous.

It will be appreciated that the overall vertical height of the mailboxing system 10, and the numbers of bins provided, is a matter of design choice and selection, and may be related to the number of potential shared users and the printer capability. For example, it may be desirable that the mailboxing system's overall maximum sheet capacity match or exceed the printer's paper tray capacity, so that the mailbox system can store a full load of paper from the printer and thus be unloaded at the same time the paper tray in the printer has to be accessed to be reloaded.

It will also be appreciated that various additional features known from the above cited and other art may be readily incorporated with the present mailboxing or other plural sheets plural trays or bins sheet sets separation and storage system without interference from the above-described bin capacity changing system. For example, sheet registration enablers, cross-process registration tampers, sheet removal systems, etc., similar to those used in conventional bins or trays.

With the disclosed system, mailbox bins which are not being utilized, that is, do not have printer output indicated by the controller 100, or bins that have had all of their previous stacked output unloaded (removed), can be reduced to a minimum inter-bin spacing and capacity. This can be actuated automatically after the emptying of a bin. Bin emptying can be automatically detected by in-bin bin-empty sensors such as those disclosed in the above or other references such as Xerox Corp. U.S. Pat. No. 5,328,169 issued Jul. 12, 1994 to Barry P. Mandel and U.S. Pat. No. 5,435,544 issued Jul. 25, 1995 to Barry P. Mandel. That is, all empty or nearly empty bins can all be moved closer together automatically so that they are almost directly superimposed. This automatically provides substantially increased vertical space available in the overall bin array (defined by the total length of both sections of the lead screws) for greatly increased sheet stacking capacity in those bins which are or will be used.

Note that the capacity of the bin 18 being loaded can be increased either before or during the feeding of sheets therein with this system. It is automatic based on the known sheet output for that bin from the printer. No manual removal or movement of bins or trays is required. The limit on bin capacity will occur only if the sum of the current set capacities or spacing of all of the bins has reached the maximum provided by the overall lead screw length. As noted, since bins are periodically emptied their user or owner coming up to the mailboxing unit for that purpose, when the sheets are removed from a given bin, that bin empty sensor signal within the bin, signals the tray empty condition and the bin capacity of that bin can be minimized preferably subsequently during the next time when the mailboxing unit is not being fed additional sheets by operating the lead screw segments together to move that particular bin up to the intersection of the lead screw segments. The immediately overlying bin will stop in its proper location and the underlying bin which is at the bin entrance 20, will now be lower relative thereto since the job sets were all removed therefrom. Thus the bottom lead screw segment can be driven by stepper motor M2 in a clockwise mode to reduce the capacity of that empty bin to its minimum, preferably in whole increments of the lead screw pitch so as to ensure that the top lead screw segment which is not moved in a bottom lead screw which has moved relative thereto, still have a continuous thread engagement at their interface. It will also be appreciated that the empty bin could be held stationary on the lower lead screw segment just as it reaches the interface with the upper lead screw segment and the upper lead screw segment rotated to move the overlying bin down to the close that bin spacing, as an alternative to the steps described above.

While the system 10 described above is a vertical array of substantially horizontal bins for a mailboxing system, it will be appreciated that the novel principles disclosed herein have broader applications. For example, it is known in the sorter art that there are other types of bin movement mechanisms, and it is also known to provide horizontal arrays of substantially vertical bins.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a printed sheets distribution system for a printer comprising an array of multiple adjacent stacking bins into which printed sheets from the printer are selectively directed to be stacked in selected individual said bins, wherein different numbers of said printed sheets are selectively directed to different individual said bins, the improvement comprising an automatic bin capacity adjustment system which automatically increases or decreases the sheet stacking capacity of said selected individual said bins relative to other said bins in response to said different numbers of said printed sheets being directed to said selected individual said bins, said automatic bin capacity adjustment system automatically changing the spacing between selected said adjacent stacking bins to provide said automatically increases or decreases in the sheet stacking capacity of said selected individual said bins relative to said other bins;

wherein said automatic bin capacity adjustment system comprises plural coaxial but independently rotatable screw threaded bin movement members, and a controlled drive system rotating at least one of said screw threaded bin movement members relative to another to change the spacing between adjacent said bins.

2. The printed sheets distribution system of claim 1, comprising a multiple mailbox bins mailboxing system for stacking therein print jobs of said printed sheets from said printer, wherein different individual said mailbox bins are assigned to different individual users of said printer, and wherein said printer is a shared users printers with plural said individual users respectively having variable numbers and sizes of print jobs, and wherein said print jobs of said individual users are separately directed to separate said individual said mailbox bins separately assigned to said individual users, and wherein said automatic bin capacity adjustment system automatically changes said sheet stacking capacity of said individual said mailbox bins for said individual users respectively having variable numbers and sizes of print jobs.

3. The printed sheets distribution system of claim 2, wherein said print jobs of said printed sheets from said printer are manually removable from said mailbox bins by said individual users, and wherein said automatic bin capacity adjustment system automatically reduces said sheet stacking capacity of said individual said mailbox bins from which said print jobs of said printed sheets have been so removed.

4. The printed sheets distribution system of claim 1 wherein said controlled drive system alternatively commonly rotates said plural coaxial but independently rotatable screw threaded bin movement members to commonly move said bins without changing the spacing between said bins.

5. In a mailboxing system for a shared users printer with different individual users, comprising an array of multiple adjacent mailbox bins, which mailboxing system separates and temporarily stores different numbers of printed sheets for said different users of said shared users printer in different said mailbox bins; the improvement comprising an automatic mailbox bin capacity adjustment system automatically varying the spacing between said mailbox bins to provide different sheet capacities for different said mailbox bins for said different numbers of printed sheets of said different users of said shared users printer;

wherein said automatic bin capacity adjustment system comprises plural coaxial but independently rotatable screw threaded bin movement members, and a controlled drive system rotating at least one of said screw threaded bin movement members relative to another to change the spacing between adjacent said mailbox bins to change the sheet stacking capacity of selected said mailbox bins.

6. The mailboxing system of claim 5, wherein said printed sheets are manually removable from individual said mailbox bins by said individual users, and wherein said automatic bin capacity adjustment system automatically reduces said sheet stacking capacity of said individual said mailbox bins from which said printed sheets have been so removed to increase the available sheet stacking capacity of other said mailbox bins of said mailboxing system.

7. The mailboxing system of claim 5, wherein said controlled drive system alternatively commonly rotates said plural coaxial but independently rotatable screw threaded bin movement members to commonly move said bins without changing the spacing between said bins relative to a sheet entrance position for said mailbox bins.

8. In a mailboxing system for a shared users printer with different individual users, comprising an array of multiple adjacent mailbox bins, which mailboxing system separates and temporarily stores different numbers of printed sheets for said different users of said shared users Printer in different said mailbox bins; the improvement comprising an automatic mailbox bin capacity adjustment system automatically varying the spacing between said mailbox bins to provide different sheet capacities for different said mailbox bins for said different numbers of printed sheets of said different users of said shared users printer;

wherein said automatic bin capacity adjustment system comprises a plurality of screw threaded bin movement members to which said mailbox bins are independently operatively attached in a vertical array, each said screw threaded bin movement member having upper and lower sections which are coaxial and have mating threads but are independently rotatable, and two separate and separately controlled drive motors connected to separately rotate said upper and lower sections of said screw threaded members relative to another to change the spacing between adjacent said mailbox bins to change the sheet stacking capacity of selected said mailbox bins.

9. A method of storing different numbers of printed sheets for different users of a shared users printer in different mailbox bins of an array of multiple mailbox bins, comprising automatically changing the spacing between selected adjacent mailbox bins to provide selectably different sheet storing capacities for different mailbox bins for the different numbers of printed sheets of the different users of the shared users printer;

wherein said automatic changing of the spacing between selected adjacent mailbox bins is provided by different relative rotations of at least two coaxial but independently rotatable screw threaded bin movement members, rotating at least one of said screw threaded bin movement members relative to the other to change the spacing between adjacent said mailbox bins to change the sheet stacking capacity of selected said mailbox bins.

10. The method of storing different numbers of printed sheets for different users of a shared users printer in different mailbox bins of claim 9, wherein said automatic changing of the spacing between selected adjacent mailbox bins is provided by a mailbox bins movement system which also sequentially moves said bins relative to a sheet entrance position from which the printed sheets are fed into said bins.

11. The printed sheets distribution system of claim 1, wherein said automatic bin capacity adjustment system comprises at least two said coaxial but differently rotatable screw threaded bin movement members operatively engaging said bins.

12. The mailboxing system of claim 5, wherein said controlled drive system differently rotates at least one of at least two said coaxial but independently rotatable screw threaded bin movement members operatively connected to said mailbox bins for said varying of said spacing between said mailbox bins.

13. The mailboxing system of claim 5, wherein said mailbox bins are in a superposed array, and wherein said same automatic bin capacity adjustment system with said same controlled drive system also sequentially moves said bins relative to a sheet entrance position from which the printed sheets are fed into said mailbox bins.

* * * * *